US007514613B2

(12) United States Patent
Yamaguchi

(10) Patent No.: US 7,514,613 B2
(45) Date of Patent: Apr. 7, 2009

(54) KEYBOARD DEVICE FOR KEYBOARD INSTRUMENT

(75) Inventor: Tsutomu Yamaguchi, Shizuoka-ken (JP)

(73) Assignee: Kabushiki Kaisha Kawai Gakki Seisakusho, Shizuoka-ken (JP)

( * ) Notice: Subject to any disclaimer, the term of this patent is extended or adjusted under 35 U.S.C. 154(b) by 242 days.

(21) Appl. No.: 11/185,857

(22) Filed: Jul. 21, 2005

(65) Prior Publication Data

US 2006/0021490 A1 Feb. 2, 2006

(30) Foreign Application Priority Data

Jul. 28, 2004 (JP) ..... 2004-219821

(51) Int. Cl.
*G10C 3/18* (2006.01)

(52) U.S. Cl. ..... 84/236; 84/433

(58) Field of Classification Search ..... 84/236, 84/434, 433
See application file for complete search history.

(56) References Cited

U.S. PATENT DOCUMENTS 3,230,128 A 1/1966 French
3,422,720 A 1/1969 Johnson
4,205,583 A 6/1980 Absmann
4,510,839 A 4/1985 Kumano
4,756,225 A 7/1988 Carlsson et al.
5,406,875 A * 4/1995 Tamai et al. ..... 84/433
6,087,575 A * 7/2000 Niitsuma ..... 84/423 R
7,208,668 B2 * 4/2007 Shimoda ..... 84/434
2002/0194982 A1 12/2002 Suzuki et al.

FOREIGN PATENT DOCUMENTS

JP 2000-056766 2/2000
JP 2003-177739 6/2003

* cited by examiner

*Primary Examiner*—Walter Benson
*Assistant Examiner*—Jianchun Qin
(74) *Attorney, Agent, or Firm*—Crowell & Moring LLP

(57) ABSTRACT

A keyboard device for a keyboard instrument, which can be manufactured by a simplified manufacturing process and at reduced manufacturing costs, is disclosed. A keyframe is formed by a molded piece of a synthetic resin. A plurality of front rail pins and a plurality of balance rail pins are arranged in a juxtaposed manner in a left-right direction at a front part and a central part of the keyframe in a front-rear direction. A plurality of keys are made of wood and each have a balance rail pin hole formed in a central portion thereof in the front-rear direction. The keys are swingably supported on the keyframe in a state where the balance rail pins are each engaged with the balance rail pin hole associated therewith and at the same time the keys are prevented from being swung in the left-right direction by the front rail pins associated therewith.

13 Claims, 3 Drawing Sheets

KEYBOARD DEVICE FOR KEYBOARD INSTRUMENT

BACKGROUND OF THE INVENTION

1. Field of the Invention

This invention relates to a keyboard device for a keyboard instrument, and more particularly to a keyframe of the keyboard instrument, which is disposed on a keybed and used for supporting components, such as keyboard assemblies.

2. Description of the Related Art

Conventionally, as the keyboard device of the conventional keyboard instrument, there has been proposed one disclosed in Japanese Laid-Open Patent Publication (Kokai) No. 2003-177739 (see pages 3 and 4, and FIG. 1). This keyboard device includes a keyframe provided on a keybed, and a multiplicity of keys arranged on the keyframe. The keyframe is comprised of a keyframe front, a keyframe center, and a keyframe rear, which extend longitudinally, a pair of left and right keyframe plates, and three inner bunches disposed inward of these, and these components are connected to each other into an assembly and each formed by a molded piece of a synthetic resin.

Further, the keyframe center has a multiplicity of balance rail pins erected thereon, and each balance rail pin is engaged with a balance rail pin hole formed in the center of each key, whereby the keys are swingably supported on the keyframe center. The keyframe front as well has a multiplicity of front rail pins erected thereon, and each front rail pin is engaged with a front rail pin hole formed in the bottom of each key, whereby the keys are prevented from swinging horizontally. According to the keyboard device constructed as above, the keyframe is composed of molded pieces of a synthetic resin, whereby it is possible to easily obtain components having high dimensional accuracy, which makes it unnecessary to perform finishing work on each component. This simplifies the manufacturing process, whereby the manufacturing costs can be reduced. Further, the components has high shape retention against aging and dryness or humidity, which makes it possible to prevent deformation, such as warpage, of the keyboard assembly.

The keyboard device including such a keyframe suffers from the following problem: Since the keyframe is comprised of a plurality of components, as described above, the number of the components is large, and it is necessary to connect the components to each other, which increases the number of assembly steps, resulting in an increase in manufacturing costs. Further, since the keyframe is an assembly of the components, there is a fear of assembly error, and it takes much time to adjust the mounting positions of the keys, etc., which also results in an increase in manufacturing costs.

SUMMARY OF THE INVENTION

It is an object of the present invention to provide a keyboard device for a keyboard instrument, which is high in quality and can be manufactured by a simplified manufacturing process and at reduced manufacturing costs.

To attain the above object, in a first aspect of the present invention, there is provided a keyboard device for a keyboard instrument, comprising:

a keyframe formed by a molded piece of a synthetic resin;

a plurality of front rail pins arranged in a juxtaposed manner in a left-right direction at a front part of the keyframe in a front-rear direction;

a plurality of balance rail pins arranged in a juxtaposed manner in the left-right direction at a central part of the keyframe in the front-rear direction;

a plurality of keys made of wood and each having a balance rail pin hole formed in a central portion thereof in the front-rear direction; and a first reinforcing member made of metal and provided in a vicinity of the balance rail pins for reinforcement of rigidity of the keyframe, wherein the keys are swingably supported on the keyframe in a state where the balance rail pins are each engaged with the balance rail pin hole associated therewith and at the same time the keys are prevented from being swung in the left-right direction by the front rail pins associated therewith.

According to this keyboard device, the keyframe is formed by a molded piece of a synthetic resin, and the keys are swingably supported on the keyframe by engaging the balance rail pin hole formed in the center of each key with the associated balance rail pin of the keyframe. This enables the key to be vertically swung in accordance with depression thereof. Further, the front rail pins prevent the keys from being swung in the left-right direction. Moreover, the first reinforcing member made of metal and extending in the left-right direction is provided in the vicinity of the balance rail pins of the keyframe, whereby the rigidity of the keyframe, particularly part thereof in the vicinity of the balance rail pins, is reinforced.

With this arrangement of the keyboard device according to the first aspect of the present invention, since the keyframe is formed by a molded piece of s synthetic resin, it is possible to obtain a high dimensional accuracy of the keyframe. Further, the keyframe is almost free from warpage and bend caused by environmental changes, such as changes in humidity. Moreover, since the rigidity of part of the keyframe in the vicinity of the balance rail pins is reinforced, deformation of the keyframe is suppressed when the mounting position of each key is adjusted by bending the balance rail pin with which the key is engaged, and the balance rail pins are strongly supported, which maintains the positional relationship between the balance rail pins. Therefore, it is possible to perform adjustment of the positions of the keys easily and accurately. Thus, it is possible to obtain a high-quality keyboard device, and simplify the manufacturing process.

Preferably, the keyboard device further comprises a second reinforcing member provided in a vicinity of the front rail pins of the keyframe.

With the arrangement of this preferred embodiment, the second reinforcing member made of metal is provided in the vicinity of front rail pins of the keyframe, whereby the rigidity of the keyframe is reinforced also in the vicinity of front rail pins. Therefore, when the position of each key is adjusted by bending the front rail pin associated therewith, it is possible to prevent deformation of part of the keyframe in the vicinity of front rail pins. Thus, it is possible to maintain the positional relationship not only between the balance rail pins but also between the front rail pins, which enables the position of each key to be adjusted more accurately.

More preferably, the first reinforcing member and the second reinforcing member respectively extend continuously in the left-right direction.

With the arrangement of this preferred embodiment, the first and second reinforcing members continuously extend in the left-right direction. Therefore, when adjusting the positional relationship between keys, by bending the balance rail pins and the front rail pins in the left-right direction, it is possible to effectively obtain the reinforcing effects from the reinforcing member, whereby the adjustment of the positions between the keys can be easily and accurately carried out.

Preferably, the keyframe comprises a keyframe body, and a keyframe center formed on a central part of the keyframe body in the front-rear direction such that the keyframe center extends in the left-right direction, and the balance rail pins are press-fitted in a plurality of balance rail pin recesses formed in the keyframe center, respectively, and thereby mounted on the keyframe center.

With this arrangement of the preferred embodiment, the keyframe is comprised of a keyframe body, and a keyframe center formed on a central part of the keyframe body in the front-rear direction such that the keyframe center extends in the left-right direction, and the keyframe center has the balance rail pin recesses integrally formed therein. The balance rail pins are mounted in the keyframe center by press-fitting. Therefore, since the keyframe body and the keyframe center are formed integrally with each other, there is no fear of producing assembly errors differently from the case where they are separately manufactured and then assembled with each other, and hence the balance pins can be positioned with accuracy. Further, the balance pins can be mounted only by press-fitting them in the balance rail pin recesses of the keyframe center, respectively, which makes it possible to simplify the assembly of the keyboard device. Thus, it is possible to reduce the number of components of the keyframe and simplify the assembly thereof, whereby the manufacturing costs of the keyboard device can be reduced.

Preferably, the keyframe further comprises a keyframe front formed on a front part of the keyframe body in a manner such that the keyframe front extends in the left-right direction, and the front rail pins are press-fitted in a plurality of front rail pin recesses formed in the keyframe front, respectively, and thereby mounted on the keyframe front.

With this arrangement of the preferred embodiment, the keyframe front is provided at a front part of the keyframe body in a manner extending in the left-right direction, and the keyframe front has the front rail pins press-fitted in the front rail pin recesses formed therein, respectively, and thereby mounted on the keyframe front. This makes it possible to improve the dimensional accuracy of the whole keyframe since the keyframe front is also formed integrally with the keyframe body and the keyframe center. Further, similarly to the balance rail pins, it is possible to position the front rail pins with accuracy. Further, since the front rail pins are mounted in the keyframe front only by press-fitting them in the front rail pin recesses, the assembly of the keyboard device can be more simplified. For these reasons, it possible to obtain a keyboard device which is higher in quality, and reduce the manufacturing costs thereof.

Preferably, the keyframe further comprises a hammer supporting part, and the keyboard device further comprises a plurality of hammers that are provided for the keys, respectively, and pivotally supported on the hammer supporting part, each for pivotal motion in accordance with depression of an associated one of the keys.

With this arrangement of the keyboard device, the keyframe has the hammer supporting part integrally formed therewith, and hammers provided for respective keys are pivotally supported on the hammer supporting part, whereby each hammer is pivotally moved in accordance with swinging of the key caused by depression of the key. Thus, the hammer supporting part is also integrally formed on the keyframe, i.e. the keyframe including the hammer supporting part is formed by a molded piece of a synthetic resin, which makes it possible to enhance the mounting accuracy of the hammers, thereby making it possible to obtain a high-quality keyboard device.

Preferably, the keyframe further comprises a back rail-mounting part, the keyboard device further comprising a back rail that is mounted on the back rail-mounting part, for having the keys brought into contact therewith to thereby define a key release position of the keys, and the back rail-mounting part is formed with at least one of a recess and a protrusion, for positioning the back rail in a state fixedly engaged at a predetermined location of the keyframe.

With this arrangement of the preferred embodiment, the keyframe has the back rail-mounting part integrally formed therewith, and the back rail is mounted on the back rail-mounting part. The back rail-mounting part has a recess and/or a protrusion formed therewith, and the back rail is fixedly engaged therewith, whereby the mounting position is accurately determined. As described above, the recess and/or the protrusion for positioning the back rail are/is formed integrally with the keyframe, and hence the back rail can be accurately positioned so that it is possible to accurately determine the key release position. Further, since the back rail can be mounted only by causing the same to be fixedly engaged with the back rail-mounting part, the assembly of the keyboard device can be more simplified.

Preferably, the keyframe further comprises a key switch-mounting part, the keyboard device further comprising a key switch mounted on the key switch-mounting part, for detecting key depression information on each key in accordance with depression thereof, and the key switch-mounting part is formed with at least one of a recess and a protrusion for positioning the key switch in a state fixedly engaged at a predetermined location of the keyframe.

With the arrangement of this keyboard device, the keyframe has a key switch-mounting part integrally formed therewith, and the key switch is mounted on the key switch-mounting part, for detecting key depression information for generating performance sound, in accordance with key depression. Further, the key switch-mounting part has a recess and/or a protrusion integrally formed therewith, and the key switch is fixedly engaged with these to have its mounting position accurately determined. As described above, since the recess and/or protrusion are/is integrally formed with the keyframe, for positioning the key switch, which enables the key switch to be accurately positioned. As a result, the key depression information can be detected in optimal timing, whereby the optimal timing for sounding can be determined. Further, the key switch can be positioned only by causing the key switch to be fixedly engaged with the key switch-mounting part, and hence the assembly of the keyboard device can be more simplified.

Preferably, the keyframe comprises a plurality of keyframes arranged side by side in the left-right direction, and the keyboard device further comprises a connecting member connecting the keyframes to each other.

With this arrangement of this keyboard device, the keyframes are arranged side by side in the left-right direction, and connected to each other by the connecting member. Therefore, the positional relationship between the keyframes can be positively maintained, which improves the integrity of the keyframes, whereby the assembly accuracy of the keyboard device can be enhanced.

To attain the above object, in a second aspect of the present invention, there is provided a keyboard device comprising:

a keybed having shape retention;

a keyframe front formed by a molded piece of a synthetic resin and directly provided on the keybed in a manner extending in a left-right direction;

a keyframe center formed by a molded piece of a synthetic resin and directly provided on the keybed in a manner extending in a left-right direction;

a plurality of front rail pins provided on the keyframe front in a juxtaposed manner in a left-right direction;

a plurality of balance rail pins provided on the keyframe center in a juxtaposed manner in the left-right direction; and a plurality of keys made of wood and each having a balance rail pin hole formed in a central portion thereof in the front-rear direction, wherein the keys are swingably supported on the keyframe center in a state where the balance rail pins are each engaged with the balance rail pin hole associated therewith and at the same time the keys are prevented from being swung in the left-right direction by the front rail pins associated therewith.

According to this keyboard device, on the keybed having shape retention, there are directly provided the keyframe front and the keyframe center which are made of a synthetic resin and extend in the left-right direction. Further, each front rail pin provided on the keyframe front prevents the associated key from swinging in the left-right direction, and each balance rail pin provided on the keyframe center is fixedly engaged with the associated balance rail pin hole, whereby the key is swingably supported on the keyframe center, and the mounting position of each key is finely adjusted using the associated balance rail pin.

With the arrangement of the keyboard device according to the second aspect of the present invention, the keyframe front and the keyframe center are made of a synthetic resin, and the keybed has shape retention, and therefore, deformation is difficult to occur in these members, which maintains the positional relationship between the keyframe front and the keyframe center, which in turn maintains the positional relationship between the keys provided on the keyframe center. This makes it possible to adjust the position of each key using the associated balance rail pin easily and accurately. Further, since the keyframe front and the keyframe center are directly mounted on the keybed, the construction of the keyframe is largely simplified compared with the prior art, which makes it possible to reduce the number of components and the number of assembly steps, and hence reduce the manufacturing costs of the keyboard device.

The above and other objects, features, and advantages of the invention will become more apparent from the following detailed description taken in conjunction with the accompanying drawings wherein like reference characters in the various figures are used to designate like components.

DETAILED DESCRIPTION OF PREFERRED EMBODIMENTS

Figure 1:
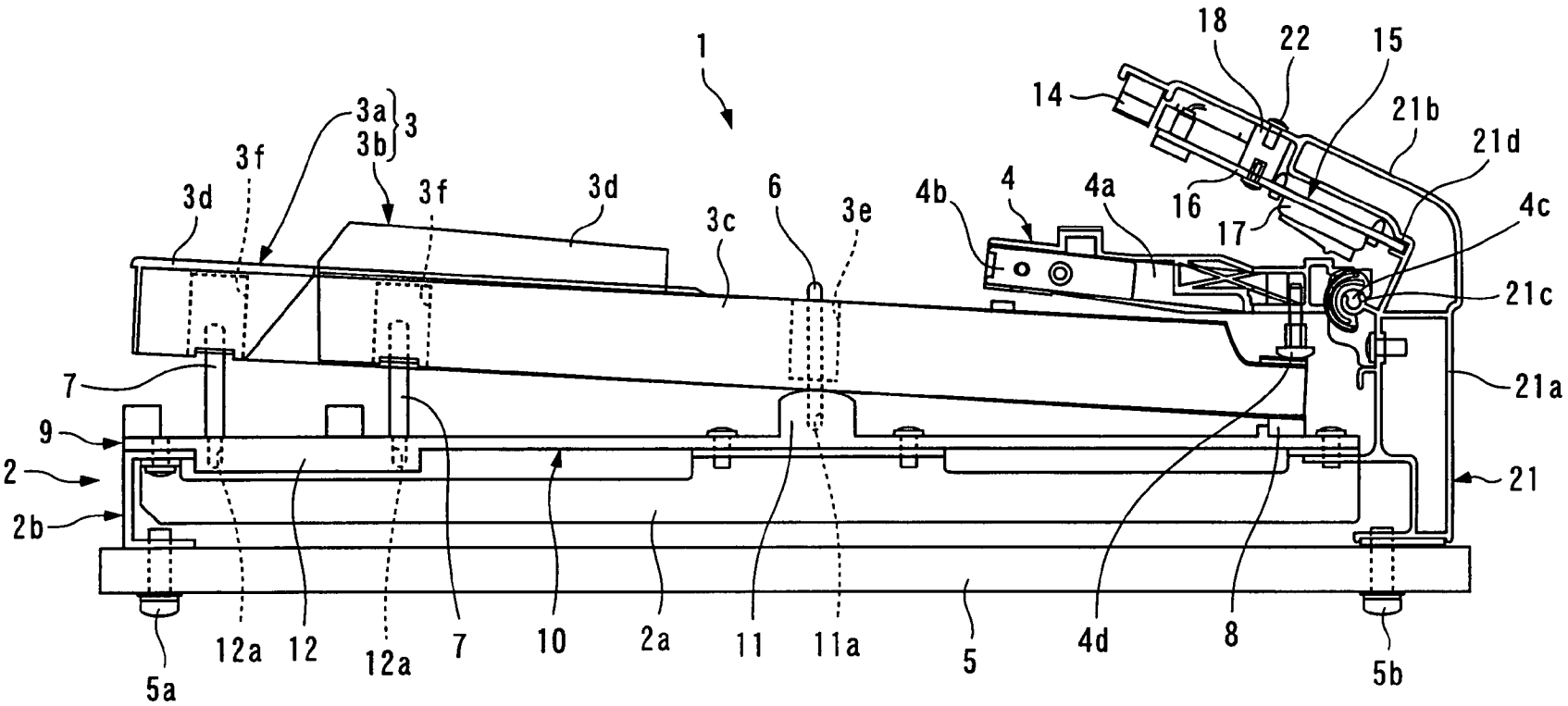
FIG. 1 is a side view showing a keyboard device according to a first embodiment of the present invention.

The invention will now be described in detail with reference to the drawings showing preferred embodiments thereof. FIG. 1 shows a keyboard device for an electronic piano, according to a first embodiment of the present invention, in a key-release position. The keyboard device 1 is comprised of a chassis assembly 2, a multiplicity of keys 3 mounted on the chassis assembly 2, in a manner arranged side by side in a left-right direction (in a direction of depth in FIG. 1), and a multiplicity of hammers 4 each of which is pivotally moved according to depression of the associated key.

The chassis assembly 2 is comprised of a keyframe 9, and a plurality of ribs 2*a* (only one of which is shown). The keyframe 9 is formed by a molded piece of a synthetic resin integrally formed as a unitary member e.g. by injection molding, and horizontally extents over a full range of notes. The keyframe 9 includes a keyframe body 10, a keyframe center 11, and a keyframe front 12. The keyframe body 10 has a generally flat shape, while the keyframe center 11 is formed on a central portion of the keyframe body 10 in a front-rear direction (left-right direction in FIG. 1) such that it protrudes upward and extends in the left-right direction. Further, the keyframe front 12 is formed at a front end of the keyframe body 10 such that it protrudes downward and extends in the left-right direction.

Further, the keyframe center 11 is formed with a multiplicity of balance rail pin recesses 11*a* (only one of which is shown) at predetermined space intervals in the left-right direction, and each balance rail pin recess 11*a* has a balance rail pin 6, referred to hereinafter, press-fitted therein, such that the balance rail pin 6 extends upward therefrom. Further, a multiplicity of front rail pin recesses 12*a* (only one of which is shown) for white keys 3*a* and black keys 3*b* are formed in an front end and a rear end of the keyframe front 12 in side-by-side arrangement in the left-right direction at respective locations corresponding to the white keys 3*a* and the black keys 3*b*. Each front rail pin recess 12*a* has a front rail pin 7, referred to hereinafter, press-fitted therein such that the front rail pin 7 extends upward therefrom.

Further, each rib 2*a* is formed by punching and bending a iron plate with a press, provided for each octave of notes such that the rib 2*a* extends along the keyframe body 10 in the front-rear direction and is fixed to the bottom of the keyframe body 10 with screws. This reinforces the rigidity of the keyframe 9 particularly in the front-rear direction. The chassis assembly 2 constructed as above is horizontally fixed to a keybed 5 via a rail 2*b* with screws 5*a*.

The keys 3 include the white keys 3*a* and the black keys 3*b*, and are each comprised of a key body 3*c* made of wood and having a rectangular cross-section, and a key cover 3*d* made of a synthetic resin and bonded to a front part of the top of the key body 3*c*. Further, the key body 3*c* has a balance rail pin hole 3*e* formed in a central portion thereof in the front-rear direction. Further, the balance rail pin hole 3*e* is engaged with the balance rail pin 6, whereby the key 3 is swingably supported on the keyframe center 11. Further, the key body 3*c* has a front rail pin hole 3*f* formed in a front end thereof such that it opens downward. The respective front pins 3*f* and 3*f* of the white key 3*a* and the black key 3*b* are engaged with the associated front rail pins 7 at respective front-offset and rear-offset locations, whereby the keys 3 are prevented from being swung in the left-right direction. Further, the mounting position of the key 3 is finely adjusted by bending root portions of the balance rail pin 6 and the front rail pin 7 in respective desired directions.

Further, a back rail 8 is disposed under a rear end of the key 3 such that it extends in the left-right direction. The back rail 8 is formed e.g. of foamed urethane, and mounted to the keyframe body 10 with a double-faced tape. Each key 3 has a rearmost portion of the bottom thereof brought into contact with the back rail 8 whereby the key release position is defined.

Each hammer 4 is provided for the associated one of the keys 3 and comprised of a hammer body 4*a* which is made of a synthetic resin and rod-shaped, and weight plates 4*b* attached to respective front portions of opposite sides of the hammer body 4*a*. The hammer body 4*a* has a rear end thereof formed with an shaft hole 4*c* which is arcuate in cross section and opens rearward. The shaft hole 4*c* of the hammer 4 is engaged with a fulcrum shaft portion 21*c* of a hammer rail 21, referred to hereinafter, whereby the hammer 4 is pivotally supported on the hammer rail 21. Further, the hammer body 4*a* has an adjustment screw 4*d* screwed in the bottom thereof at a location in the vicinity of the shaft hole 4*c* such that the adjustment screw 4*d* can be screwed forward and backward, and the hammer 4 is placed on a rearmost portion of the top of the associated key 3 via the adjustment screw 4*d*.

The hammer rail 21 is provided rearward of the chassis assembly 2 at a location adjacent thereto, and formed by one hollow extruded piece of aluminum such that it extends in the left-right direction over the length of all the hammers. The hammer rail 21 is fixed to the keybed 5 with screws 5*b*. The hammer rail 21 is comprised of a hammer supporting part 21*a* that extends vertically, a stopper-attaching part 21*b* that extends obliquely forward and upward from an upper end of the hammer supporting part 21*a*, and the fulcrum shaft portion 21 protruding forward from an upper portion of the hammer supporting part 21*a*, all integrally formed with each other.

The stopper-attaching part 21*b* has a front end thereof provided with a stopper 14 for restricting the upward pivotal motion of the hammers 4. The stopper 14 also extends over the length of all the hammers 4 in the left-right direction, and is formed of foamed urethane or the like. Further, a key switch 15 is disposed above the hammer 4, for detecting key depression information of each key 3. When the key 3 is depressed, the key switch 15 detects the key depression information thereof. The key switch 15 is comprised of a printed circuit board 16, and switch bodies 17 each formed by a rubber switch and attached to the printed circuit board 16 for the associated key 3. The key switch 15 is attached to the stopper-attaching part 21*b* via a spacer 18 with screws 22, in a state in which a rear end of the printed circuit board 16 is inserted in an engaging recess 21*d* formed at a root portion of the stopper-attaching part 21*b*.

According to the keyboard device 1, the keyframe 9 is formed by the molded piece of the synthetic resin, and hence can be easily formed with high dimensional accuracy, and does not suffer from almost any deformation, such as warpage and bend, due to environmental changes, such as changes in humidity. Therefore, it is possible to obtain the keyboard device 1 higher in quality, and simplify the manufacturing process.

Further, according to the keyboard device 1, the keyframe 9 is formed by the molded piece of the synthetic resin, so that the keyframe 9 does not suffer from almost any deformation, such as warpage and bend, due to environmental changes, such as changes in humidity, which makes it possible to obtain high dimensional accuracy. The keyframe body 10, the keyframe center 11, and the keyframe front 12 of the keyframe 9 are integrally formed with each other, and hence, as is distinct from the case in which they are separately manufactured and assembled, there is no fear of assembly error, which makes it possible to enhance the dimensional accuracy of the keyframe 9 as a whole to thereby obtain the keyboard device 1 higher in quality, and simplify the manufacturing process.

Further, since the keyframe 9 has the balance rail pin recesses 11*a* formed integrally in the keyframe center 11 and the front rail pin recesses 12*a* formed integrally in the keyframe front 12, it is possible to position the balance rail pins 6 and the front rail pins 7 with accuracy. Further, the balance rail pins 6 and the front rail pins 7 are mounted only by press-fitting the same in the associated ones of the balance rail pin recesses 11*a* and the front rail pin recesses 11*b*, respectively, and hence the assembly of the keyboard device 1 can be made simpler. Thus, the number of components of the keyframe 9 can be reduced, and the assembly thereof can be simplified, whereby the manufacturing costs of the keyboard device 1 can be reduced.

Figure 2:
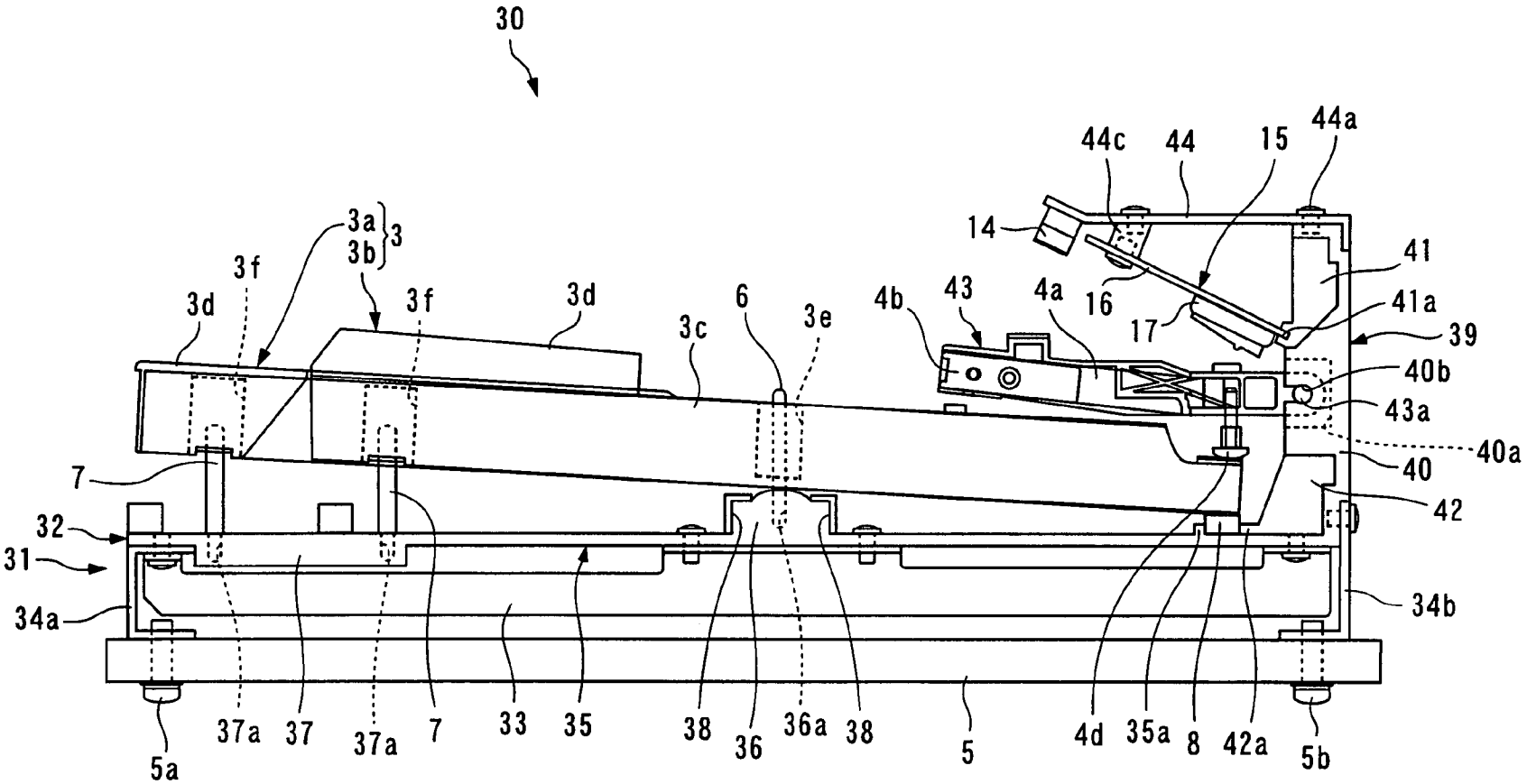
FIG. 2 is a side view showing a keyboard device according to a second embodiment of the present invention.

FIG. 2 shows a keyboard device for an electronic piano, according to a second embodiment of the present invention. The keyboard device 1 is constructed similarly to the keyboard device 1 according to the first embodiment. Therefore, components of the second embodiment similar to those of the first embodiment will be designated by identical reference numerals, and a description will be mainly given of points different from the first embodiment.

As is distinct from the first embodiment in which the keyframe 9 and the hammer rail 21 are formed by respective components separate from each other, in the second embodiment, a keyframe 32 and a base section 39 corresponding to the hammer rail 21 are integrally formed with each other. The chassis assembly 31 according to the present embodiment is comprised of a plurality of keyframes 32 thus constructed, and ribs 33 (only one of which is shown) provided for the respective keyframes 32, a front rail 34*a* (second reinforcement member, and connecting member), and a rear rail 34*b* (connecting member).

The keyframe 32 is formed by a molded piece of a synthetic resin integrally formed as a unitary member e.g. by injection molding. Further, the keyframe 32 is provided for every octave, and is comprised of a keyframe body 35, a keyframe center 36, a keyframe front 37, and the base section 39. The keyframe body 35 has a generally flat shape, while the keyframe center 36 is formed on a central portion of the keyframe body 35 in a front-rear direction (left-right direction in FIG. 2), such that it protrudes upward and extends in the left-right direction. Further, the keyframe front 37 is formed on a front end of the keyframe body 35, such that it protrudes downward and extends in the left-right direction.

The keyframe center 36 is formed with a multiplicity of balance rail pin recesses 36*a* (only one of which is shown) at predetermined space intervals in the left-right direction, similarly to the first embodiment, and each balance rail pin recess 36*a* has a balance rail pin 6, press-fitted therein, such that the balance rail pin 6 extends upward therefrom. Further, a multiplicity of front rail pin recesses 37*a* (only one of which is shown) for white keys 3*a* and black keys 3*b* are formed in side-by-side arrangement in the keyframe front 37. Each front rail pin recess 37*a* has a front rail pin 7 press-fitted therein such that the front rail pin 7 extends upward therefrom.

Further, each rib 33 is formed by punching and bending a iron plate with a press, and is fixed to the bottom of the keyframe body 35 of each keyframe 32 with screws such that the rib 33 extends along the keyframe body 10 in the front-rear direction. Further, the keyframe center 36 is provided with two reinforcing members 38 and 38 (first reinforcing members, and connection members). Each reinforcing member 38 is formed of metal, e.g. formed by bending an iron plate, such that the reinforcing member 38 has an L-shaped cross-section, and extends in the left-right direction of the keyframes 32 arranged side by side. The reinforcing members 38 are fixed to the keyframe center 36, thereby reinforcing the rigidity of the keyframe center 36 and its vicinity.

The base section 39 extends upward from the rear end of the keyframe body 35, and is comprised of a hammer supporting part 40 in the center, and a key switching-mounting part 41 and a back rail-mounting part 42 disposed upward and downward of the hammer supporting part 40, respectively. The hammer supporting part 40 is formed with a recess 40*a* for having the hammer 43 attached thereto, and a shaft hole 40*b* that opens forward, for each key 3. The hammer 43 is distinguished from the hammer 4 in the first embodiment in that the hammer 43 has a fulcrum support 43*a* formed such that the fulcrum support 43*a* protrudes from a rear end of the hammer 43 and extends in the left-right direction, and the fulcrum support 43*a* is engaged with the shaft hole 40*b*, whereby the hammer 43 is pivotally held at the hammer supporting part 40.

The key switch-mounting part 41 has a lower end formed with an engaging groove 41*a* (recess) extending in the left-right direction. Further, the base section 39 has a stopper rail 44 fixed to an upper end thereof with screws 44*a*. The stopper rail 44 extends in the left-right direction of the keyframes 32, and the stopper 14 is provided at a front end thereof, for restricting an upward pivotal motion of each hammer 43. The key switch 15 has a rear end thereof inserted in the engaging groove 41*a* for having the rear end fixedly engaged therein, and a front end thereof fixed to the stopper rail 44 via a spacer 44*c* immediately rearward of the stopper 14.

Further, the back rail-mounting part 42 has a lower end thereof formed with a protruding portion 42*a* which protrudes forward and extends in the left-right direction. The top of the keyframe body 35 has a protruding portion 35*a* formed thereon at a location spaced forward from the protruding portion 42*a* by a predetermined distance, and the protruding portion 35*a* also extends in the left-right direction. The back rail 8 is fitted between the protruding portions 35*a* and 42*a*, e.g. by double-faced tape.

Further, the front and rear rails 34*a* and 34*b* are made of metal, and extend in the left-right direction along the keyframes arranged side by side. The front rail 34*a* has a C-shaped cross-section, and an upper part thereof extends along the bottom of the keyframe body 35, and is fixed to the keyframe body 35 with screws together with the ribs 33, in a state sandwiched between the ribs 33 and the keyframe body 35, whereby the rigidity of the keyframe front 37 and its vicinity is reinforced. On the other hand, the rear rail 34*b* has an L-shaped cross-section and is fixed to the respective rear ends of the keyframes 32 with screws.

As described above, the keyframes 32 are integrally connected to each other in the state arranged side by side in the left-right direction by the reinforcing members 38 and 38 and the front and rear rails 34*a* and 34*b*, described above. Further, the rails 34*a* and 34*b* are fixed to the keybed 5 with the screws 5*a* (only one of which is shown) and the screws 5*b* (only one of which is shown), whereby the keyboard device 30 is horizontally fixed to the keybed 5. The keyboard device according to the present embodiment is constructed similarly to the keyboard device according to the first embodiment, in the other respects.

The keyboard device 30 constructed as above makes it possible to obtain the same advantageous effects as provided by the above-described keyboard device 1 according to the first embodiment. Further, the reinforcing members 38 reinforce the rigidity of part of the keyframe 32 in the vicinity of the balance rail pins 6, and hence when the mounting position of each key 3 is finely adjusted by bending the associated balance rail pin 6, deformation of the keyframe 32 is suppressed, and the balance rail pin 6 is rigidly supported. Further, the metal rail 34*a* is provided in the vicinity of the front rail pins 7 of the keyframe 32, whereby the rigidity of part of the keyframe 32 in the vicinity of the front rail pins 7 is also reinforced. Therefore, when the position of each key 3 is adjusted by bending the associated front rail pin 7, deformation of the part of the keyframe 32 in the vicinity of the front rail pins 7 can be suppressed.

Further, since the reinforcing member 38 and the rail 34*a* continuously extend in the left-right direction, it is possible to effectively obtain the advantageous effects of the reinforcement of the keyframes 32, whereby the adjustment of the positions of the keys 3 with respect to each other can be more easily and accurately carried out.

Further, the keyframe 32 have the hammer supporting part 40 integrally formed therewith, and the hammer supporting part 40 as well is formed of a molded piece of a synthetic resin, whereby the mounting accuracy of the hammer 43 can be improved and the keyboard device 1 which is higher in quality can be obtained. Further, the keyframe 32 has the back rail-mounting part 42 integrally formed therewith, and the back rail 8 is fixedly engaged with the protruding portion 42*a* of the back rail-mounting part 42 and the protruding portion 35*a* integrally formed with the keyframe body 35, whereby the mounting position of the back rail 8 is accurately determined. This enables the back rail 8 to be positioned accurately, and hence the release position of each key 3 can be accurately determined. Further, since the back rail 8 can be mounted only by fixedly engaging the same with the protruding portions 42*a* and 35*a*, the assembly of the keyboard device 30 can be more simplified.

Further, the keyframe 32 has the key switch-mounting part 41 integrally formed therewith, and the key switch 15 is engaged in the engaging groove 41*a* formed in the key switch-mounting part 41, whereby the mounting position of the key switch 15 is accurately determined. As a result, the key release information can be detected in optimal timing, whereby it is possible to obtain optimal sounding timing. Further, since the key switch 15 can be positioned only by fixedly engaging the same with the engaging groove 41*a*, the assembly of the keyboard device 30 can be more simplified.

Further, the keyframes 32 arranged side by side in the left-side direction are connected to each other by the reinforcing members 38 and 38 and the rails 34*a* and 34*b*. This makes it possible to positively maintain the positional relationship between the keyframes 32, whereby the integrity of the keyframes 32 can be improved to enhance the assembly accuracy of the keyboard device 30.

Figure 3:
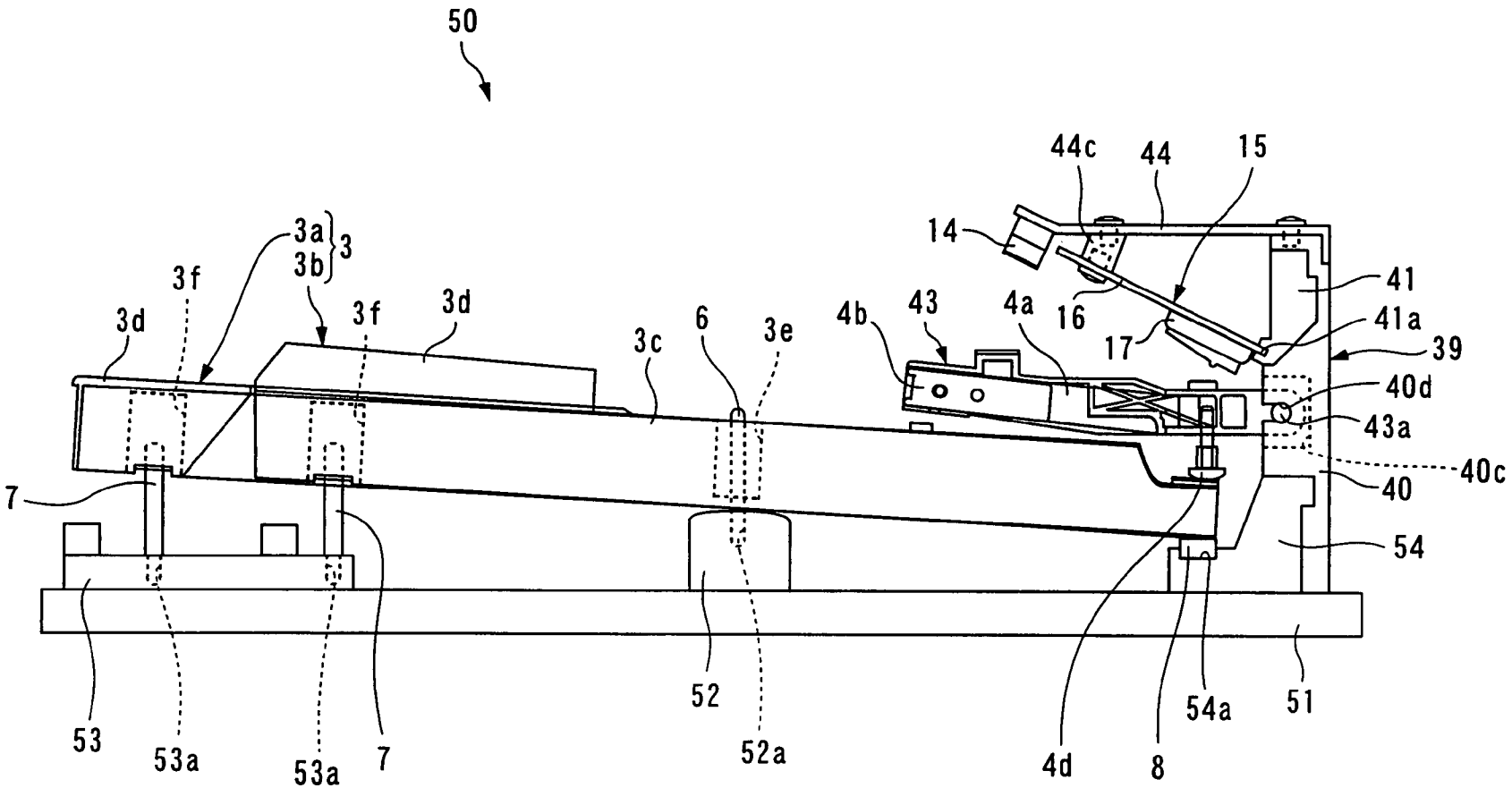
FIG. 3 is a side view showing a keyboard device according to a third embodiment of the present invention.

FIG. 3 shows a keyboard device 50 for an electronic piano, according to a third embodiment of the present invention. The keyboard device 50 is constructed similarly to the keyboard device 30 according to the second embodiment. Therefore, components of the third embodiment similar to those of the second embodiment will be designated by identical reference numerals, and a description will be mainly given of points different from the second embodiment.

As is distinct from the keyboard device 30 according to the second embodiment in which the keyframes 3 are provided on the keybed 5 via the chassis 31, in the present embodiment, the construction of the chassis 31 is largely simplified. More specifically, the keyframe body 35 and the ribs 33 are omitted, whereby a keyframe center 52, a keyframe front 53, and the base section 39 are directly mounted on a keybed 51.

The keybed 51 is made e.g. of MDF (Medium Density Fireboard), and hence it has high shape retention against environmental changes, such as changes in humidity. The keybed 51 has the keyframe center 52 fixed to a central portion thereof in the left-right direction, the keyframe front 53 to an front end thereof, and the base section 39 to a rear end thereof.

Further, the keyframe center 52 and the keyframe front 53 also have a balance rail pin recess 52*a* and a front rail pin recess 53*a* formed therein, respectively, for each key, and the balance rail pin 6 and the front rail pin 7 are press-fitted therein such that they extend upward therefrom, respectively. Further, a back rail-mounting part 54 according to the present embodiment has a groove 54*a* (recess) formed in a front part thereof such that the groove 54*a* extends in the left-right direction 52*a*, and the back rail 8 is fitted in the groove 54*a*.

According to the keyboard device 50, on the keybed 51 having shape retention, there are directly mounted the keyframe front 53 and the keyframe center 52 which are formed by molded pieces of synthetic resin and both extend in the left-right direction. These components are difficult to deform against environmental changes, such as changes in humidity, whereby the positional relationship between the keyframe front 53 and the keyframe center 52 is maintained, and the positional relationship between the keys 3 provided on the keyframe center 52 is also maintained. This makes it possible to easily and accurately adjust the position of each key 3 by the balance rail pin 6 and the front rail pin 7 associated therewith. Further, the keyframe front 53 and the keyframe center 52 are directly provided on the keybed 51, whereby the construction of the keyframe is largely simplified compared with the prior art, which makes it possible to reduce the number of components and the number of assembly steps, and thereby reduce the manufacturing costs of the keyboard device 50.

It should be noted that the present invention is by no means limited to the embodiments described above, but can be practiced in various ways. For example, although in the above-described embodiments, the balance rail pins and the front rail pins are mounted in the keyframe center and the keyframe front, by press-fitting, this is not limitative, but they may be provided by insert molding or mounted with screws. Further, in the second embodiment, the key switch 15 and the back rail 8 are fixedly engaged by providing the engaging groove 41*a* and the protruding portion 42*a*, respectively, this is not limitative, but a recess and a protruding portion for having the key switch 15 and the back rail 8 fixedly engaged therewith, respectively, can be configured as required. Further, although in the third embodiment, the keybed is made of MDF (Medium Density Fireboard), this is not limitative, but it may be formed by another material having shape retention, such as a particle board, a metal plate, or a synthetic resin.

Further, the materials of components described in the embodiments are only given by way of example, but other appropriate materials may be employed. Further, although the above-described embodiments are examples of application of the present invention to the electronic piano, this is not limitative, but the present invention can be applied to keyboard instruments of other types.

It is further understood by those skilled in the art that the foregoing are preferred embodiments of the invention, and that various changes and modifications may be made without departing from the spirit and scope thereof.

What is claimed is:

1. A keyboard device for a keyboard instrument, comprising:

a keyframe formed by a molded piece of a synthetic resin;

said keyframe formed as a single molded member, wherein the single molded member includes a flat plate-like planar keyframe body, a keyframe center upwardly projecting from a central part of said keyframe body in a front-rear direction and extending in a left-right direction, and a keyframe front on a front part of said keyframe body and extending in the left-right direction, wherein said keyframe body, said keyframe center, and said keyframe front are co-planar;

a plurality of front rail pins arranged on said keyframe front in a juxtaposed manner in the left-right direction;

a plurality of balance rail pins arranged on said keyframe center in a juxtaposed manner in the left-right direction;

a plurality of keys made of wood and each having a balance rail pin hole formed in a central portion thereof in the front-rear direction; and a first reinforcing member made of metal and provided in a vicinity of the balance rail pins for reinforcement of rigidity of the keyframe, wherein said keys are swingably supported on said keyframe center in a state where said balance rail pins are each engaged with the balance rail pin hole associated therewith and at the same time said keys are prevented from being swung in the left-right direction by said front rail pins associated therewith.

2. A keyboard device as claimed in claim 1, further comprising a second reinforcing member provided in a vicinity of said front rail pins of said keyframe.

3. A keyboard device as claimed in claim 2, wherein said first reinforcing member and said second reinforcing member respectively extend continuously in the left-right direction.

4. A keyboard device as claimed in claim 1, wherein said balance rail pins are press-fitted in a plurality of balance rail pin recesses formed in said keyframe center, respectively, and thereby mounted on said keyframe center.

5. A keyboard device as claimed in claim 4, wherein said front rail pins are press-fitted in a plurality of front rail pin recesses formed in said keyframe front, respectively, and thereby mounted on said keyframe front.

6. A keyboard device as claimed in claim 1, wherein said keyframe further comprises a hammer supporting part, and the keyboard device further comprising:

a plurality of hammers that are provided for said keys, respectively, and pivotally supported on said hammer supporting part, each for pivotal motion in accordance with depression of an associated one of said keys.

7. A keyboard device as claimed in claim 1, wherein said keyframe further comprises a back rail-mounting part, the keyboard device further comprising a back rail that is mounted on said back rail-mounting part, for having said keys brought into contact therewith to thereby define a key release position of said keys, and wherein said back rail-mounting part is formed with at least one of a recess and a protrusion, for positioning said back rail in a state fixedly engaged at a predetermined location of said keyframe.

8. A keyboard device as claimed in claim 1, wherein said keyframe further comprises a key switch-mounting part, the keyboard device further comprising a key switch mounted on said key switch-mounting part, for detecting key depression information on each key in accordance with depression thereof, and wherein said key switch-mounting part is formed with at least one of a recess and a protrusion for positioning said key switch in a state fixedly engaged at a predetermined location of said keyframe.

9. A keyboard device as claimed in claim 1, wherein said keyframe comprises a plurality of keyframes arranged side by side in the left-right direction, the keyboard device further comprising a connecting member connecting said keyframes to each other.

10. A keyboard device comprising:

a keybed having shape retention;

a keyframe front formed by a molded piece of a synthetic resin wherein the keyframe front molded piece is mounted on an upper surface of said keybed and extends from the upper surface of said keybed without a keyframe body of a keyframe and without a chassis connecting the keyframe front to the keybed, said keyframe front extending in a left-right direction;

a keyframe center formed by a molded piece of a synthetic resin wherein the keyframe center molded piece is mounted on the upper surface of said keybed and extends from the upper surface of said keybed without a keyframe body of a keyframe and without a chassis connecting the keyframe center to the keybed, said keyframe center extending in a left-right direction;

a plurality of front rail pins provided on said keyframe front in a juxtaposed manner in a left-right direction;

a plurality of balance rail pins provided on said keyframe center in a juxtaposed manner in the left-right direction; and a plurality of keys made of wood and each having a balance rail pin hole formed in a central portion thereof in the front-rear direction, wherein said keys are swingably supported on said keyframe center in a state where said balance rail pins are each engaged with the balance rail pin hole associated therewith and at the same time said keys are prevented from being swung in the left-right direction by said front rail pins associated therewith.

11. A keyboard device as claimed in claim 10, wherein the keyframe front is a flat, elongated member that is in direct engagement with the keybed along an entire length of the flat, elongated member and wherein the plurality of front rail pins are disposed in the flat, elongated member.

12. A keyboard device as claimed in claim 10, wherein a lower surface of the keyframe center is in direct engagement with the upper surface of the keybed.

13. A keyboard device as claimed in claim 10, wherein the keyframe front and the keyframe center are discontiguous structures with respect to each other.

* * * * *